United States Patent [19]

Masters, III

[11] 4,189,790

[45] Feb. 26, 1980

[54] SHOWER SHIELD

[76] Inventor: Carson W. Masters, III, 52 E. Union Blvd., Bethlehem, Pa. 18018

[21] Appl. No.: 949,421

[22] Filed: Oct. 6, 1978

[51] Int. Cl.[2] ..... A47K 3/14; A47K 3/22

[52] U.S. Cl. ..... 4/149; 4/154;

[58] Field of Search ..... 4/145, 149, 148, 154, 4/153; 160/349 R, 349 D

[56] References Cited

U.S. PATENT DOCUMENTS

| | | | |
|---|---|---|---|
| 1,807,107 | 5/1931 | Sternbergh | 4/145 |
| 3,737,921 | 6/1973 | Baumrind | 4/145 X |
| 3,895,399 | 7/1975 | Giarrante | 4/149 |
| 3,952,337 | 4/1976 | Hansow | 4/148 |
| 3,984,880 | 10/1976 | Schrameyer | 4/148 |
| 4,077,072 | 3/1978 | Dezura | 4/154 |
| 4,102,353 | 7/1978 | Pugliese | 160/349 R |

*Primary Examiner*—Henry K. Artis

*Attorney, Agent, or Firm*—Clarence A. O'Brien; Harvey B. Jabobson

[57] ABSTRACT

An elongated channel member is provided including a first open longitudinal side outwardly of which said channel member opens and a second remote side defining a planar abutment surface disposed normal to the direction in which the first side of the channel member opens. The planar abutment surface has adhesive structure supported therefrom whereby the planar abutment surface may be abutted against and adhesively secured to a tub-shower stall wall extending upwardly from one end of the outer side wall of an associated tub and the open side of the channel member has one longitudinal edge portion of an upstanding panel member secured therein. The panel member includes a second longitudinal edge portion which projects outwardly from the channel member and the lower end of the channel member and the lower end edge of the panel member may abut the upper edge of the outer side wall of the associated tub with the channel member and panel member extending upwardly along the adjacent wall of the associated tub-shower enclosure. The lower end of the channel member, the lower end of the panel member and the opposite longitudinal marginal edge of the abutment surface of the channel member may be sealed, by means of opposite side beads of suitable sealant, to the upper surface of the outer side wall of the associated tub and the opposing end wall surfaces of the associated tub-shower enclosure.

1 Claim, 4 Drawing Figures

SHOWER SHIELD

BACKGROUND OF THE INVENTION

Various forms of tub-shower stall spary deflectors have been heretofore provided. However, these previously known forms of spray deflectors have not been particularly well adapted for ease of installation. Accordingly, a need exists for a tub-shower splash deflector which may be marketed at a low cost and readily installed, even by inexperienced persons, in operative relation relative to a tub and an associated tub-shower stall.

Examples of previously known forms of spray deflectors and/or diverters for use in conjunction with tub and/or shower stall enclosures are disclosed in U.S. Pat. Nos. 1,807,107, 2,107,885, 2,303,502, 3,104,014, 3,737,921, 3,808,610 and 3,895,399.

Although some of the aforementioned previously known tub-shower stall splash or spray deflectors are operative to deflect water against spraying and splashing out of a tub-shower stall, they are not specifically designed in a manner whereby they may be readily manufactured at a low cost and yet also be readily installed by even inexperienced persons.

BRIEF DESCRIPTION OF THE INVENTION

The tub-shower stall spray deflector of the instant invention includes an elongated channel member including a first open longitudinal side and a second remote and closed side defining a planar abutment surface disposed normal to the direction in which the open side of the channel member opens. The planar abutment surface has adhesive structure supported therefrom whereby the abutment surface may be readily adhesively secured in position against one end wall of a tub-shower stall. Once the channel member has been secured in position the opposite longitudinal edges of the channel member and opposite side portions of the lower end of the channel member may be sealed relative to the adjacent tub-shower stall end wall surfaces and the upper edge of the outer side wall of the associated tub. In addition, one longitudinal ege of a spray deflector panel is secured within the open longitudinal side of the channel member and the panel projects outwardly from the open side of the channel member. In addition to the lower end of the channel member being sealed relative to the opposing upper surface of the outer side wall of the associated tub, the lower end edge of the panel member may also be sealed, on its opposite sides, relative to the upper surfaceof the outer end wall of the associated tub.

The main object of this invention is to provide an inexpensive tub-shower stall spray deflector which may be readily installed even by inexperienced persons.

Another object of this invention is to provide a spray deflector in accordance with the preceding objects and including a mounting channel member for securement to an associated tub-shower stall wall as well as a spray deflector panel supported from the channel member in a manner such that the panel member may be removed and/or replaced, if desired.

Another important object of this invention is to provide a tub-shower stall spray deflector which may be readily used in conjunction with substantially all forms of tub-shower stall enclosures.

A final object of this invention to be specifically enumerated herein is to provide a spray deflector in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
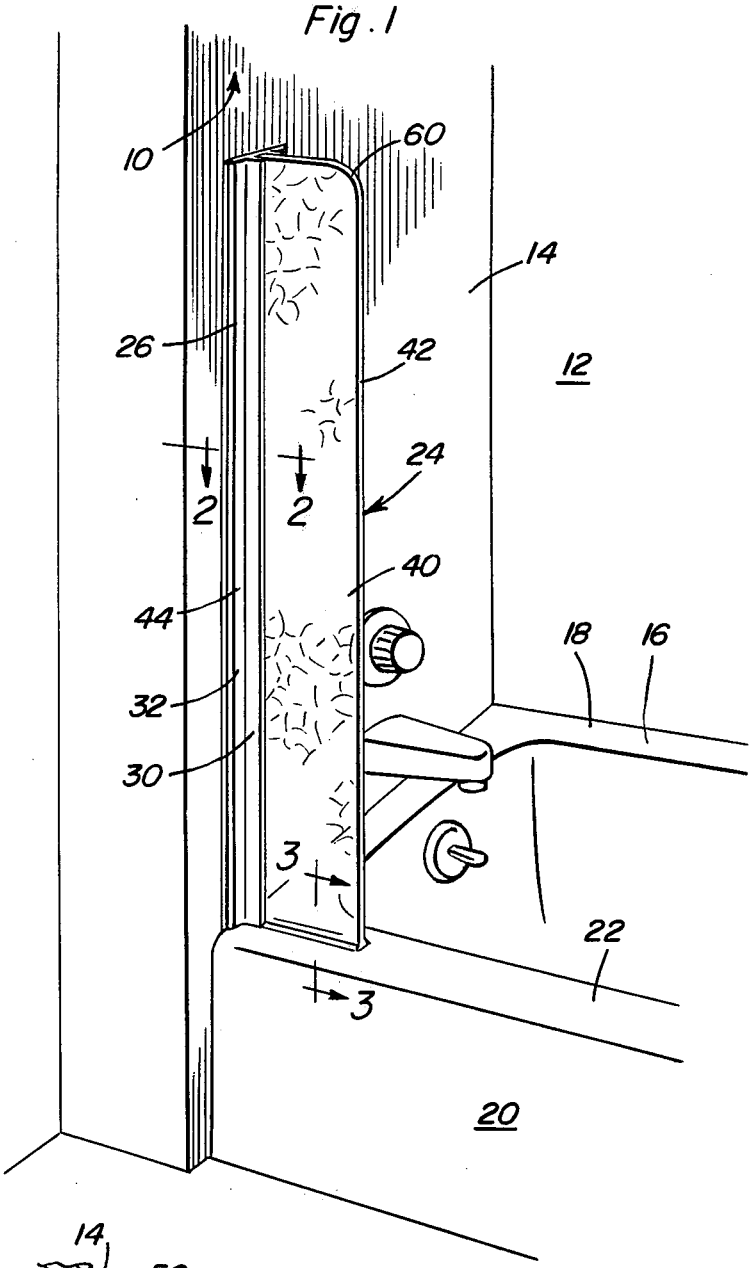
FIG. 1 is a perspective view of a conventional tub-shower enclosure with the deflector of the instant invention supported in operative association with one end wall of the enclosure and the adjacent end of the upper edge of the outer side wall of the associated tub.
Figure 4:
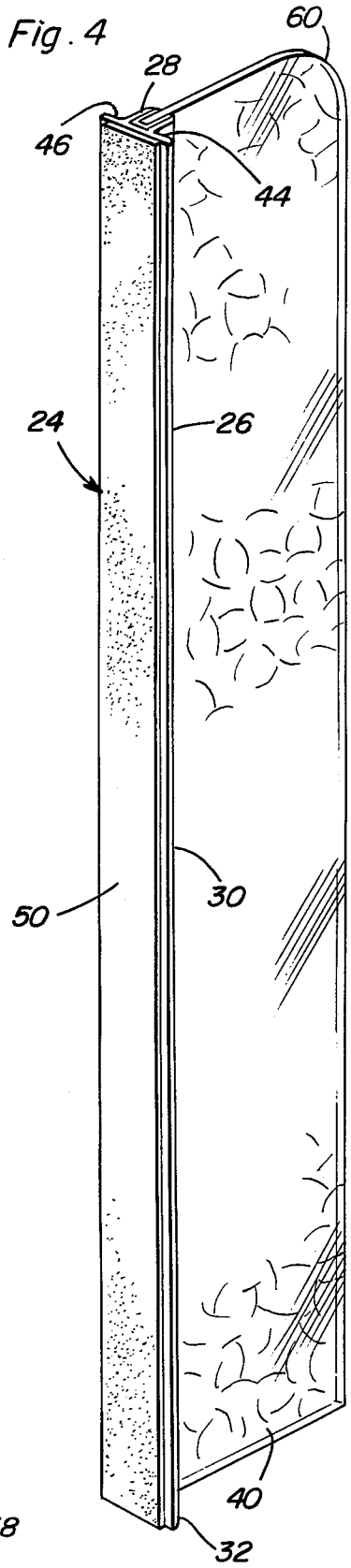
FIG. 4 is an enlarged perspective view of the tub-shower stall splash deflector of the instant invention.

Referring now more specifically to the drawings, the numberal 10 generally designates a tub-shower stall enclosure including an inner wall 12, a first end wall 14 and a second end wall (not shown) generally paralleling and opposing the end wall 14. A conventional tub 16 including an inner side wall 18 and an outer side wall 20 is interposed between the first and second end walls outwardly of the inner wall 12 and the outer wall 20 of the tub 16 includes an upper marginal edge 22. One end of the tub 16 abuts the lower portion of the end wall 14 and the tub-shower splash deflector of the instant invention is referred to in general by the reference numeral 24.

The deflector 24 includes an extruded plastic or aluminum channel member 26 including parallel opposite side flanges 28 and 30 and one pair of longitudinal edges of the flanges 30 are interconnected by means of a wide abutment flange 32 closing one side of the channel member 26. The channel member 26, therefore, defines an open side 34 extending therealong between the free longitudinal marginal edge portions of the flanges 28 and 30 remote from the abutment flange 32 and a channel shaped spline 36 is seated within the channel member 26 between the flanges 28 and 30.

One longitudinal marginal edge portion 38 of a translucent plastic panel 40 is seated within the support spline 36 and is thereby supported from the channel member 26. The panel 40 includes a longitudinal marginal edge portion 42 remote from the marginal edge portion 38 and the edge portions 38 and 42 generally parallel each other.

Figure 2:
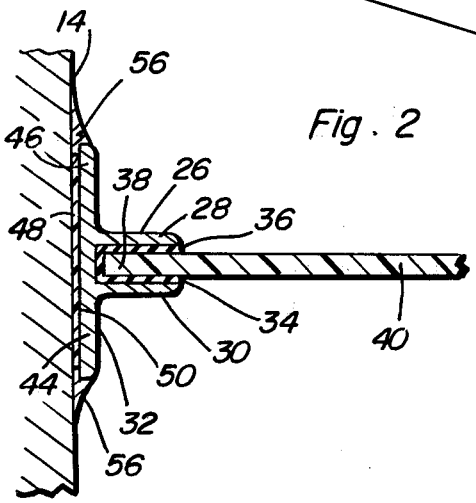
FIG. 2 is an enlarged fragmentary horizontal sectional view taken substantially upon the plane indicated by the section line 2—2 of FIG. 1.
Figure 3:
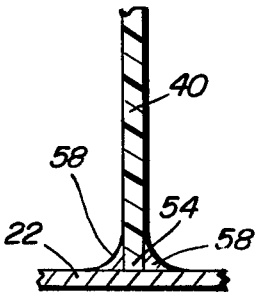
FIG. 3 is an enlarged fragmentary vertical sectional view taken substantially upon the plane indicated by the section line 3—3 of FIG. 1.

The abutment flange 32 includes opposite side longitudinal marginal portions 44 and 46 which project laterally outwardly from opposite sides of the channel member 26 and the abutment flange 32 defines a planar abutment surface 48 facing in the direction opposite to the direction in which the open side 34 of the channel member 26 opens. Double sided adhesive tape 50 is secured to the planar abutment surface 48 and the channel member 26 extends upwardly along the end wall 14 from the adjacent end of the upper marginal edge 22 of the outer side wall 20 of the tub 16. The adhesive tape 50 adhesively secures the channel member 26 in position on the wall 14 in the manner illustrated in FIGS. 1 and 2 of the drawings with the lower end of the channel member 26 abutted against the upper marginal edge 22 of the outer side wall 20. In addition, the lower end of the panel 40 includes a lower marginal edge 54 which abuts the upper marginal edge 22 of the outer side wall 20 and a pair of beads 56 of suitable transparent sealant material are utilized along the remote longitudinal marginal edges of the abutment flange 32 for forming a fluid tight seal between the abutment flange 32 and the end wall 14. Further, a similar bead (not shown) of transparent sealant material is utilized to form a fluid tight seal between the upper end of the abutment flange 32 and the end wall 14 and yet another pair of beads 58 of transparent sealant material are utilized along the lower end marginal edge 54 of the panel 40 to form a fluid tight seal between the panel 40 and the upper marginal edge 22 of the outer side wall 20 of the tub 16.

It may thus be seen that the channel member 26 may be inexpensively produced as an extrusion, that the support spline 36 may also be inexpensively produced as an extrusion and that the panel 40 may comprise a relatively inexpensive panel of translucent plastic. Further, upper outer corner of the panel 40 may be radiused as at 60.

From the foregoing it is believed that it will be apparent that the deflector 24 may be readily installed in position along the end wall 14 above the upper marginal edge 22 of the outer side wall 20 of the tub 16, even by inexperienced persons. The abutment flange 32 is first adhesively secured in position relative to the end wall 14 and the various beads of sealant are subsequently placed in position.

The foregoing is considered as illustrative only of the principles of the invention. Further, since numerous modifications and changes will radily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a tub-shower enclosure including an upright structural member defining one upright side of an entrance and exit opening for said enclosure and including a tub outer side wall extending horizontally away from said structural member and including an upper edge defining the lower extremity of said opening, an elongated upstanding panel structure including upstanding opposite longitudinal marginal portions, one of said marginal portions being transversely widened relative to the remainder of said panel structure and defining a generally planar edge surface extending along said one marginal portion and disposed generally normal to the plane of said panel structure, said surface being of a width appreciably greater than the width of the other longitudinal marginal portion of said panel structure and including a length of double sided adhesive stripping adhesively secured thereover and generally centered relative thereto with the opposite side edges of said stripping spaced inwardly of the corresponding longitudinal marginal portions of said surface, the adhesive side of said stripping remote from said surface being adhered to said structural member with the lower end edge of said panel structure closely overlying and extending along said upper edge of said tub outer side wall, a pair of moisture sealing beads of sealant material extending between said marginal portions of said surface and the opposing surfaces of said structural members along both side edges of said adhesive stripping, and a second pair of moisture sealing beads of sealant material extending along opposite sides of the lower end edge of said panel structure and the adjacent opposing portions of said tub wall upper edge.

* * * * *